United States Patent [19]

Rebischung

[11] Patent Number: 4,919,742

[45] Date of Patent: Apr. 24, 1990

[54] METHOD FOR MANUFACTURING A LID FOR CLOSING A CONTAINER COMPRISING A THERMOPLASTIC MATERIAL SEALING ZONE

[75] Inventor: Robert A. Rebischung, Selestat, France

[73] Assignee: Societe Alsacienne d'Aluminium, France

[21] Appl. No.: 328,093

[22] Filed: Mar. 23, 1989

Related U.S. Application Data

[62] Division of Ser. No. 195,871, May 19, 1988, Pat. No. 4,830,215.

[30] Foreign Application Priority Data

May 20, 1987 [FR] France ..... 87 07077

[51] Int. Cl.[5] ..... B32B 31/18

[52] U.S. Cl. ..... 156/269; 156/256; 156/257; 156/324; 220/276; 220/359

[58] Field of Search ..... 156/256, 257, 269, 324; 220/276, 359

[56] References Cited

U.S. PATENT DOCUMENTS

| | | | |
|---|---|---|---|
| 3,973,719 | 8/1976 | Johnson et al. | 220/359 X |
| 4,109,818 | 8/1978 | Hascoe et al. | 220/359 X |
| 4,418,834 | 12/1983 | Helms et al. | 220/359 |
| 4,636,273 | 1/1987 | Wolfersperger | 156/244.11 |
| 4,735,335 | 4/1988 | Torterotot | 220/359 X |
| 4,738,374 | 4/1988 | Ingemann | 220/258 |
| 4,757,914 | 7/1988 | Roth et al. | 220/359 |
| 4,801,041 | 1/1989 | Takata et al. | 220/359 |

*Primary Examiner*—Robert A. Dawson
*Assistant Examiner*—James Engel
*Attorney, Agent, or Firm*—Finnegan, Henderson, Farabow, Garrett & Dunner

[57] ABSTRACT

The lid according to the invention is for closing, by thermosealing, a container having a thermoplastic material sealing zone (3) defined by an internal closed line and an external closed line, of the type comprising a closure material (5), a varnish (7) applied to one of the faces of the closure material and an added thermoplastic material layer (6) fixed separably to the closure material and covering at least a part of the varnish which is intended to face the sealing zone of the container to be closed, said lid being characterized in that the added layer (6) has a thickness of the order of 100 to 1000$\mu$ ($10^{-4}$ to $10^{-3}$ m), its thickness being chosen so that the thermoplastic material forming it may, by locally melting during closure of the container by thermosealing, encapsulate the traces of product finding its way on to the sealing zone during filling of the container. Such a lid can be manufactured by forming in a strip of plastic material a first series of openings whose periphery corresponds substantially to the inward closed line.

2 Claims, 1 Drawing Sheet

Figure 1:
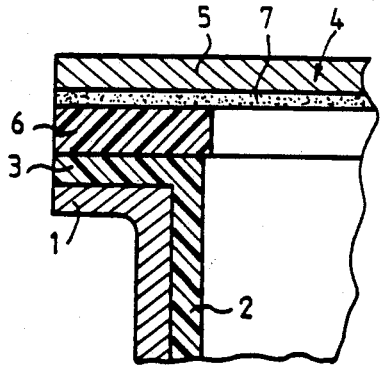

METHOD FOR MANUFACTURING A LID FOR CLOSING A CONTAINER COMPRISING A THERMOPLASTIC MATERIAL SEALING ZONE

This is a division of application Ser. No. 07/195,871, filed May 19, 1988, now U.S. Pat. No. 4,830,215.

The present invention relates to a lid for closing by thermosealing a container comprising a thermoplastic material sealing zone defined by an internal closed line and by an external closed line, of the type comprising a closure material, a varnish applied to one of the faces of the closure material and an added thermoplastic material layer fixed separably to the closure material and covering at least the part of the varnish which is intended to face the sealing zone of the container to be closed, as well as the method for manufacturing such a lid.

It often happens, during filling of containers of the above type, that traces of the product to be packed find their way on to the sealing zone. These traces unfortunately have the drawback of preventing perfect sealing of the lids on the containers and consequently lead to rapid degradation of the packed product.

The purpose of the present invention is more particularly to overcome this drawback and, for this, it has as object a lid of the above type which is characterized in that the added layer has a thickness of the order of 100 to 1000$\mu$ ($10^{-4}$ to $10^{-3}$m), its thickness being chosen so that the thermoplastic material forming it may, by locally melting during closure of the container by thermosealing, encapsulate the traces of prduct reaching the sealing zone during filling of the container.

The closure of a container with a lid of the invention by thermosealing may be provided with a perfect seal. In fact, since the added layer and the sealing zone are both made from a thermoplastic material, by locally melting under the effect of heat, this material encapsulates the traces of the product which are present on the sealing zone and therefore avoids, at the level of these traces, the formation of micro-channels which might cause sealing defects to appear.

The thermoplastic material forming the added layer has a thickness of the order of 0.1 to 10 times the thickness of the sealing zone of the container. It is preferably the same as that forming the sealing zone of the container. It may for example be chosen from the group comprising polyvinyl chloride, polyethylene and polypropylene and may have a thickness of about 100 to 1000$\mu$ ($10^{-4}$ to $10^{-3}$m). It may moreover be fixed on the closure material by means of a varnish having a thickness of about 10 to 20$\mu$ ($10^{-5}$ to $2\times10^{-5}$m).

As for the closure material, it has a thickness of the order of 20 to 100° ($2\times10^{-5}$ to $10^{-4}$m) and may comprise at least one thermoplastic material foil and/or at least one metal foil.

In a modification of the lid, the added layer covers the whole face of the closure material which is intended to be turned towards the container and is pre-cutout along a line corresponding substantially to the internal closed line of the sealing zone of the container.

The added layer may thus be torn along its pre-cut line on opening the container, its part situated inside the internal closed line remaining fixed to the closure material.

The present invention also reduces to a maximum the costs of producing the above described lid. For this, it provides a manufacturing process which is characterized in that it consists successively in forming in a thermoplastic material strip a first series of openings whose periphery corresponds substantially to the closed line defining the sealing zone of the container inwardly, fixing a closure material strip to the thermoplastic material strip comprising the first series of openings and forming in the complex thus obtained a second series of openings whose periphery corresponds substantially to the closed line defining the sealing zone of the container externally, the openings of the second series being formed so that the openings of the first series are closed by the closure material.

In a particular embodiment, this process may consist successively in depositing against the bottom of a lower mold shell a closure material element whose dimensions correspond to those of the lid to be formed, applying against the closure material element an upper mold shell having on its face turned towards said closure material element a groove having an inlet whose dimensions correspond to those of the added layer, injecting a thermoplastic material into the groove of the upper mold shell so as to form the added layer, removing the upper mold shell after the thermoplastic material has set and removing the lid thus formed from the lower mold shell.

In another embodiment the method of the invention may consist in molding the added layer, preferably by injection, and fixing thereon a closure material element whose dimensions correspond to those of the lid to be formed.

Furthermore, in order to produce lids whose added layer covers the whole face of the closure material which is intended to be turned towards the container to be closed, the present inveniton proposes a method consisting successively in forming in a thermoplastic material strip a series of pre-cutouts whose contour corresponds substantially to the closed line defining the sealing zone of the containers inwardly, fixing a closure material strip on the thermoplastic material strip comprising the pre-cutouts and forming in the complex thus obtained a series of openings whose periphery corresponds substantially to the closed line defining the sealing zone of the containers externally, the openings being formed so that the pre-countouts are covered by the closure material.

Figure 2:
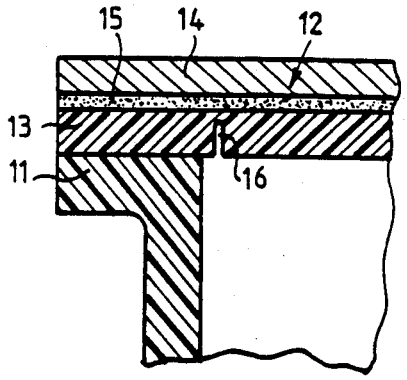
Figure 3:
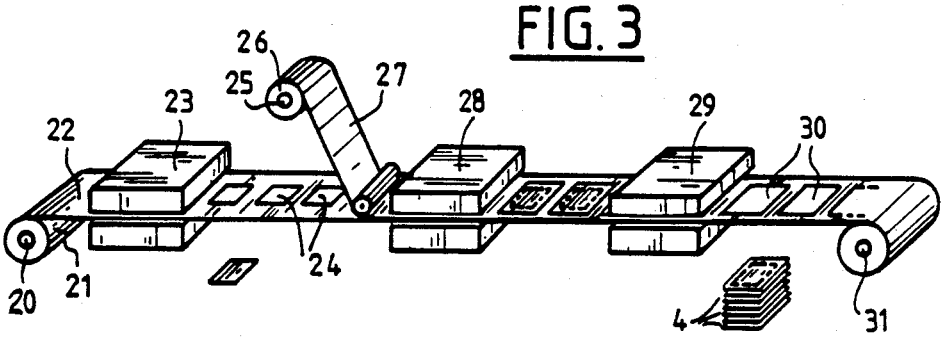
Figure 4:
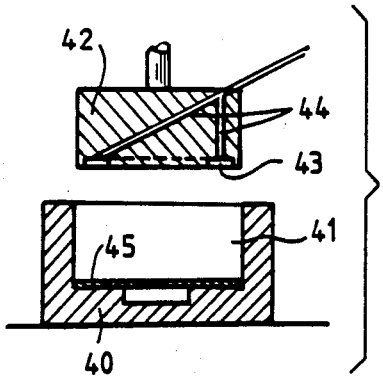

Two embodiments of the present invention will be described hereafter by way of examples, with reference to the accompanying drawings in which:

FIG. 1 is a schematical and partial sectional view of a container closed by a lid of the invention, FIG. 2 is a schematical and partial sectional view of a container closed by another lid of the invention, FIG. 3 is a schematical perspective view of an installation for manufacturing lids such as the one partially shown in FIG. 1, and FIG. 4 is a schematical perspective view of a mold for manufacturing lids having the same structure as those produced by the installation shown in FIG. 3.

Referring to FIG. 1, the container comprises a peripheral flange 1 surrounding its inlet and is coated inwardly with a layer of thermoplastic material 2 extending over the peripheral flange 1 so as to form a sealing zone 3. It will be noted that this zone may have a thickness of the order of 10 to 10000$\mu$ ($10^{-5}$ to $10^{-2}$ m).

This container, which is quite conventional, is closed by a lid 4 comprising a closure material 5 having, on its portion overhanging the sealing zone 3, an added thermoplastic material layer 6.

The added layer 6 is fixed separably to the closure material 5 by a varnish 7 having a thickness of about 10 to 20μ ($10^{-5}$ to $2.10^{-5}$m). It may for example be made from polyvinyl chloride, polyethylene or polypropylene, the thermoplastic material forming it being possibly the same or not as that used for forming the sealing zone 3. Its thickness may further be between 100 and 1000μ ($10^{-4}$ to $10^{-3}$m).

As for the closure material 5, it may be formed by a complex comprising at least one thermoplastic material foil and/or at least one aluminium foil and with a thickness of about 20 to 100μ ($2.10^{-5}$ to $10^{-4}$m).

To close the container shown in FIG. 1, the added layer 6 of the lid 4 is applied to the sealing zone 3 of the container and the added layer 6 and the sealing zone 3 are heated so as to cause them to melt on each side of their contact area and thus to weld them together.

It will be noted that the thicknesses of layer 6 and of sealing zone 3 are appreciably greater than that of the traces of the product contained in the container which may be possibly present on said sealing zone 3.

It will also be noted that the added layer 6 and the sealing zone 3 may be advantageously heated by ultra sounds.

To open the container with lid 4, it is of course sufficient to separate the closure material 5 from the added layer 6, which raises no difficulty since varnish 7 allows it to be peeled off.

The container shown in FIG. 2 is made entirely from a thermoplastic material and has a thickness of about of 100 to 10000μ ($10^{-4}$ to $10^{-2}$m). It has a peripheral flange forming a sealing zone 11 about its inlet and is closed by a lid 12 having an added layer 13 fixed to the closure material 14 by a varnish layer 15. In fact, lid 12 is distinguished from lid 4 which has been described above solely by the fact that the added layer 13 covers the whole of the face of the closure material 14 which is turned towards the container and is pre-cutout along a line 16 adjacent the internal periphery of the sealing zone 11.

Since lid 12 may be sealed in the same way as lid 4, the operations to be carried out for fixing it to the container will not be repeated here.

The installation shown in FIG. 3 has been designed for mass producing lid 4. It comprises a spindle 20 receiving a reel 21 obtained by winding up a strip of thermoplastic material 22 for forming the added layer 6 of the lids 4, a cutting out station 23 for forming in strip 22 a succession of openings 24 whose dimensions correspond substantially to those of the openings of the containers to be closed, spindle 25 receiving a reel 26 obtained by winding up a strip 27 of closure material, a sealing station 28 for fixing the perforated strip 22 and strip 27 one against the other, a cutting out station 29 for producing the lids 4 by forming in strips 22 and 27, concentrically with openings 24, a succession of openings 30 whose dimensions correspond substantially to those of the external periphery of the flange 1 of the containers to be closed, a spindle 31 for winding up the strips 22 and 27 when they leave the cutting out station 29, and control means not shown for causing spindles 20, 25 and 30 to rotate in synchronism in the direction allowing strips 22 and 27 to move in the same direction.

The installation shown in FIG. 3 could also be used for mass producing lid 22 after small modifications. It would in fact be sufficient to replace the cutting out station 23 by a pre-cutting out station capable of forming in strip 22 cut-outs 16 whose contours would correspond substantially to that of the opening of the containers to be closed.

The mold shown in FIG. 4 has also been designed for mass production of lid 4. It comprises a lower shell 40 with a cavity 41 whose bottom has dimensions slightly greater than those of lid 4, and an upper shell 42 formed so as to penetrate with a small clearance into cavity 41, shell 42 having on its lower face an annular groove 43 connected to channels 44 adapted for injecting a thermoplastic material therein, groove 43 having an inlet whose dimensions are substantially the same as those of flange 1 of the containers to be closed.

To form a lid 4 with the mold shown in FIG. 4, the following is the procedure to be followed:

- on the bottom of cavity 1 of the lower shell 40 is placed a closure material element 45 whose dimensions correspond to those of the lid 4,
- the upper shell 42 is applied against the closure material element 45,
- a thermoplastic material is injected into groove 43 of the upper shell 42 so as to form the added layer 6 of lid 4,
- the upper shell 42 is removed from cavity 41 of the lower shell 40 after the thermoplastic material has set, and
- the lid 4 thus formed is removed from the lower shell 40.

Lid 4 could also be formed by first of all molding the added layer 6, for example by injection, then by fixing on said added layer a closure material element whose dimensions correspond to those of lid 4.

I claim:

1. A method for manufacturing a lid for closing a container having a thermoplastic material sealing zone defined by an inner and outer edge, said lid having a layer of closure material, a varnish applied to one face of the closure material and a thermoplastic material layer fixed to and covering at least a part of the varnish which is intended to face the sealing zone of the container to be closed, comprising successively forming in a strip of thermoplastic material a series of openings whose periphery corresponds substantially to the inner edge of the sealing zone of the containers, thereafter fixing a closure material strip having a layer of varnish on one side thereof on one side of the thermoplastic material strip with the varnish lying adjacent the thermoplastic material strip and cutting out from the complex thus obtained a series of the lids whose periphery corresponds substantially to the outer edge of the sealing zone of the containers, the lids being formed so that the openings are closed by the closure material.

2. A method for manufacturing a lid for closing a container having a thermoplastic material sealing zone defined by an inner and outer edge, said lid having a layer of closure material, a varnish applied to one face of the closure material and a thermoplastic material layer fixed to and covering at least a part of the varnish which is intended to face the sealing zone of the container to be closed, comprising successively forming in a strip of thermoplastic material a series of pre-cutouts on one side of the strip whose contour corresponds substantially to the inner edge of the sealing zone of the containers, thereafter fixing a strip of closure material having a layer of varnish on one side thereof on the opposite side of the thermoplastic material strip with the varnish lying adjacent the thermoplastic material strip, and cutting out from the complex thus obtained a series of lids whose periphery corresponds substantially to the outer edge of the sealing zone of the containers, the lids being formed so that the pre-cutouts are covered by the closure material.

* * * * *